US006454561B1

(12) United States Patent
Colthar et al.

(10) Patent No.: US 6,454,561 B1
(45) **Date of Patent: *Sep. 24, 2002**

(54) CANDLE WICK CLIP, CANDLE AND METHOD

(75) Inventors: James R. Colthar, Hillsboro; Timothy Jay Glasgo, Williamsburg; Michael C. Cole, Wilmington, all of OH (US)

(73) Assignee: Lancaster Colony Corp., Columbus, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/314,650

(22) Filed: May 19, 1999

(51) Int. Cl.[7] ..... F23D 3/16

(52) U.S. Cl. ..... 431/289; 431/301; 431/35; 425/803

(58) Field of Search ..... 431/289, 288, 431/290, 291, 301, 304, 294, 320, 292, 323, 322, 35; 425/803; 44/519, 275; 264/271.1, 274, 279

(56) References Cited

U.S. PATENT DOCUMENTS

| | | | | |
|---|---|---|---|---|
| 1,267,968 A | | 5/1918 | Bulle | 431/291 |
| 1,320,109 A | * | 10/1919 | Wooster | 431/291 |
| 1,344,446 A | | 6/1920 | Engman | 431/291 |
| 1,345,960 A | * | 7/1920 | Rosenberger | 431/291 |
| 1,660,760 A | * | 2/1928 | Murphy | 431/291 |
| 2,240,071 A | * | 4/1941 | Gisolfi | 431/291 |
| 2,274,823 A | * | 3/1942 | Candy, Jr. | 431/289 |
| 2,291,067 A | * | 7/1942 | Atkins | 431/291 |
| 3,285,694 A | * | 11/1966 | Marchi | 431/291 |
| 3,462,235 A | | 8/1969 | Summers | 431/289 |
| 3,797,990 A | | 3/1974 | Rogers et al. | 431/291 |
| 3,831,899 A | | 8/1974 | Doig | 425/803 |
| 3,910,753 A | * | 10/1975 | Lee | 431/290 |
| 4,206,500 A | | 6/1980 | Neil | 431/291 |
| 4,332,548 A | | 6/1982 | Linton et al. | 431/289 |
| 4,477,249 A | | 10/1984 | Ruzek et al. | 431/289 |
| 5,690,484 A | | 11/1997 | Leonard et al. | 431/291 |
| 5,842,850 A | * | 12/1998 | Pappas | 431/291 |
| 5,961,318 A | * | 10/1999 | Chambers et al. | 431/291 |

FOREIGN PATENT DOCUMENTS

| | | | |
|---|---|---|---|
| DE | 3918591 | * | 9/1990 |
| DE | 19806404 A1 | | 9/1998 |
| EP | 4376 | * | 3/1894 |
| GB | 2080514 A | | 2/1982 |
| WO | WO 96/21124 | | 7/1996 |

OTHER PUBLICATIONS

Triplett, Carl, Memo to R. C. Colins II, *Results of Large Scale Candle Burning Tests* (*Massive Burn I and II*), The Dial Corporation, Feb. 13, 1997.

Triplett, Carl, Memo to Bob Collins/Mark McElfresh, *Tabulation of all Candle Burn Data*, The Dial Corporation, Feb. 25, 1997.

* cited by examiner

*Primary Examiner*—Ira S. Lazarus
*Assistant Examiner*—Josiah C. Cocks
(74) *Attorney, Agent, or Firm*—Dinsmore & Shohl LLP

(57) ABSTRACT

The present invention relates to a wick clip assembly for candles to be used on a supporting surface, as well as a method for making such assemblies, and candles incorporating the same. According to one embodiment, a wick receiving member is disposed adjacent to the top of a base. A generally open skirt extends downwardly from the base, and is adapted to maintain the base in a predetermined spaced relationship relative to a supporting surface in use. The bottom end of a wick penetrates the base and is securely attached to the wick clip assembly by the wick receiving member such that its bottom end is located above the supporting surface in use. The clip provides enhanced control over heat transfer from the flame to the supporting surface, while optimizing performance of the candle.

25 Claims, 10 Drawing Sheets

CANDLE WICK CLIP, CANDLE AND METHOD

TECHNICAL FIELD

The present invention relates generally to structural members for candles; and, more particularly, to a wick clip assembly for a candle which optimizes the burning of the candle wax to minimize undesired heat transfer to the adjacent surface of a candle holder or display.

BACKGROUND OF THE INVENTION

Candles have long been used for many reasons, including as a light source, as a mood or ambience enhancement, and/or as a means to dispense and disperse materials, such as fragrances and insect repellants. Typically, such candles include a fibrous wick immersed in a fuel source, such as wax. In wax or paraffin candles, the flame of the burning candle melts a portion of the solid fuel into a molten fuel pool, which in turn comes into contact with at least a portion of the wick. When a candle is lit, the wick draws the fuel through its fibers via capillarity and the fuel is vaporized to feed the flame.

As a candle burns, extraneous material, such as bits of carbon from either the wick or a match used to light the candle, may collect in the fuel pool. If the burning wick comes into contact with this extraneous material, the flame from the wick may ignite the extraneous material which can raise the temperature of the wax high enough to vaporize the wax and cause a sudden explosion of flame often called "flaring." To prevent the wick from collapsing into the fuel pool and extinguishing the flame or igniting such extraneous material as the wick is being burned closer to the bottom of the candle, a wick clip is often provided in the bottom of the candle to hold the wick in an erect position.

Oftentimes, candles are placed in holders or on supporting surfaces to avoid having the candle's fuel flow onto or adhere to the candle's location during use. As used herein, "supporting surface" is used to connote any surface upon which the candle is placed for burning. In candles with conventional wick clips, as the wick burns closer to the base of the candle and the wax pool diminishes, an increasing amount of heat is transferred from the flame, through the wick clip, through the melted wax pool, and to the supporting surface. As the heat transferred from the wick clip to the adjacent portion of the supporting surface increases over that being experienced by the remainder of the supporting surface, supporting surfaces formed from materials such as glass and the like can be damaged, such as by fracturing or cracking.

It is known in the art to provide a candle with "self-extinguishing" capability. Using a wick clip to elevate the exposed portion of the bottom end of a wick from a supporting surface cuts the wick off from the fuel pool once the pool level drops below that portion of the wick, thereby extinguishing the candle and retaining a fuel pool on the supporting surface. Ensuring that a minimum melt pool remains throughout the lifetime of the candle helps distribute the heat across a larger portion of the supporting surface, and can also tend to help keep extraneous material away from the flame. In other words, in addition to extinguishing the candle, elevating the wick also serves to separate the primary flame from the extraneous material in the fuel pool as the pool lowers.

Conventional self-extinguishing wick clips, however, are not effective at reducing the heat transferred from the wick clip to the supporting surface. Typical self-extinguishing wick clips extinguish the candle as soon as the fuel level drops below the neck of the clip. Moreover, hot melt glue or other structure or materials must be applied to the bottom of typical self-extinguishing wick clips to seal off the bottom of the wick from the fuel. Otherwise, a meniscus of fuel can form under the wick clip that allows the wick to draw substantially all of the fuel off of the supporting surface before extinguishing. The added step of applying this seal creates relatively complex manufacturing steps and tolerances, and leads to greater expense and inefficiency in the manufacturing process. Furthermore, the seals created by this process are often ineffective, allowing the wick to undesirably draw most or all of the fuel off the supporting surface before extinguishing. As can be understood, failure to maintain a minimum melt pool of unconsumed wax allows the heat of the flame to be concentrated on the supporting surface.

Although "footed" wick clips (clips which have some small spacer or protuberance on their lower surface) are known in the field, they are likewise relatively ineffective at dissipating heat. Moreover, such wick clips have either ineffective or non-existent self-extinguishment characteristics. Therefore, there remains a need for a wick clip that more reliably reduces heat transfer and has optimal self-extinguishing capabilities.

SUMMARY OF THE INVENTION

Accordingly, an object of this invention is to provide an improved wick clip which addresses the shortcomings and failures of clips available heretofore.

Another object of the invention is to provide a wick clip that reduces the amount of heat transferred to a supporting surface.

Still a further object of the invention is to provide a wick clip that has superior self-extinguishing capabilities.

Yet another object of the invention is to provide such a wick clip with reduced manufacturing costs.

Additional objects, advantages and novel features of the invention will be set forth in part in the description that follows and in part will become apparent to those skilled in the art upon examining or practicing the invention. The objects and advantages of the invention may be realized and obtained by means of the instrumentalities and combinations particularly pointed out in the appended claims.

To achieve the foregoing and other objects, and in accordance with the purpose of the present invention as described above, a wick clip assembly for candles to be used on a supporting surface is provided. According to one embodiment of this invention, a wick receiving member is disposed adjacent to the top of a base. A generally open skirt extends downwardly from the base, and is adapted to maintain the base in a predetermined spaced relationship relative to a supporting surface in use. The bottom end of a wick penetrates the base and is securely attached to the wick clip assembly by the wick receiving member such that its bottom end is located above the supporting surface in use.

In a preferred form, the wick receiving member comprises a generally tubular conformation, is centrally disposed on the base in a substantially vertical orientation, and is crimped to securely attach the wick to the clip assembly. Preferably, the skirt comprises a plurality of downwardly extending legs and a plurality of flow passages between adjacent legs. While the self-extinguishing capabilities of the wick clip assembly are maximized if each of the surface areas of the flow passages are larger than the surface area of the corresponding leg, approximately equal surface areas of corresponding passages and legs are preferred. Furthermore, the base, wick receiving member, and skirt are preferably integrally connected and formed from a thin, non-flammable material, such as steel.

In another form, the invention provides a method for making a wick clip for a candle to be used with a candle display having a support surface. One provides a base and a wick receiving member attached to it, and bends the base along a plurality of equidistant bend lines to form a plurality of downwardly extending legs and flow passages. A wick is attached to the wick receiving member.

While the base can have a variety of initial conformations, such as generally round, generally polygonal conformations, such as triangular, are preferred. Preferably, the wick is attached to the base such that its bottom end extends downwardly below the base only a portion of the length of the legs. In yet a further preferred embodiment, the bottom end is generally coplanar with the base. Both of these embodiments preferably locate the bottom end of the wick in a position spaced upwardly from a supporting surface in use.

In still another embodiment, the invention provides a method for making a candle with a supported wick. One preferably provides a candle with a wick passage that runs between the candle's upper and lower ends, a base with a wick receiving member attached to it, and a wick that is longer than the wick passage. The wick is secured to the wick receiving member adjacent to the wick's bottom end, and the base is bent along a plurality of equidistant bend lines to form a plurality of flow passages and downwardly extending legs. The top end of the wick is inserted into and passed through the wick passage until the distal ends of the downwardly extending legs are generally coplanar with the lower end of the candle. The formation of the legs and passages can be undertaken before, after, or during attachment of the wick to the base.

In a preferred form, the bottom end of the wick extends downwardly from the base for a distance which is less than the downwardly extended length of the distal ends of the legs. In yet a further preferred embodiment, the bottom end of the wick is generally coplanar with the base. In this way, the wick bottom will be spaced upwardly from the bottom-most portion of the clip, and will be spaced from a supporting surface in use.

Still other aspects of the present invention will become apparent to those skilled in the art from the following description of a preferred embodiment, which is simply by way of illustration several of the best modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and together with their description serve to explain the principles of the invention. In the drawings.

DETAILED DESCRIPTION OF THE PREFERRED EMBODIMENTS

Figure 1:
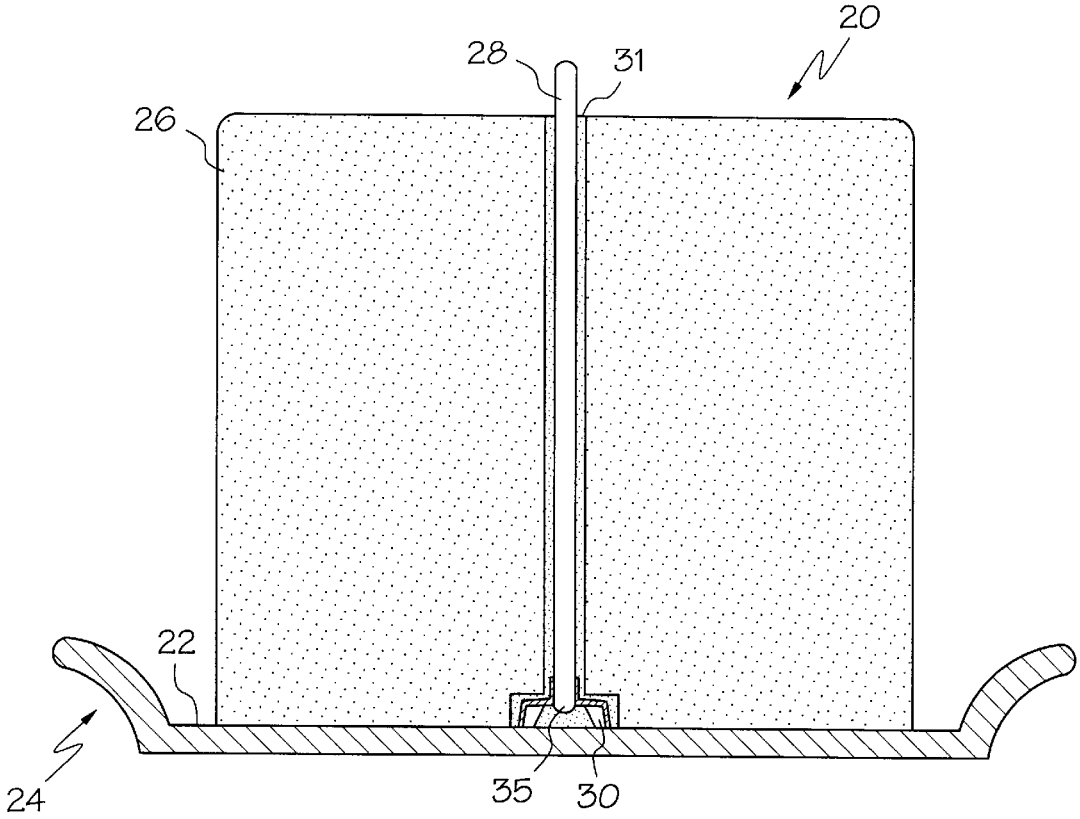
FIG. 1 shows a cross-sectional view of a candle with a wick clip assembly according to one embodiment of this invention.

Referring now to the drawings in detail, wherein like numerals indicate the same elements throughout the views, FIG. 1 depicts an exemplary candle 20 resting on a supporting surface 22 of a display 24. As indicated above, the support surface 22 can be part of a candle holder, a glass jar, an open cup, or other surface upon which the candle 20 is supported for display and burning. Display 24 is illustrated as a relatively shallow open dish simply as an example.

The candle 20 is at least partially comprised of a fuel 26, such as, for example, wax. Materials, such as fragrances and insect repellants, may also be carried by the fuel 26 for dispersion into the surrounding environment. As shown in the Figure, the wick 28 and wick clip 30 assembly is illustrated as being at least partially disposed within the fuel 26.

The wick 28 and wick clip 30 assembly is preferably disposed within a passage 31 running substantially vertically through the candle 20. Preferably, the passage 31 is configured to fittingly conform to the wick 28 and wick clip 30. While some candles are formed by conventional dipping procedures (where there will be no passage at all), many others are formed by molding or pressing procedures, with a passage 31 being formed to receive a wick 28 thereafter.

Figure 2:
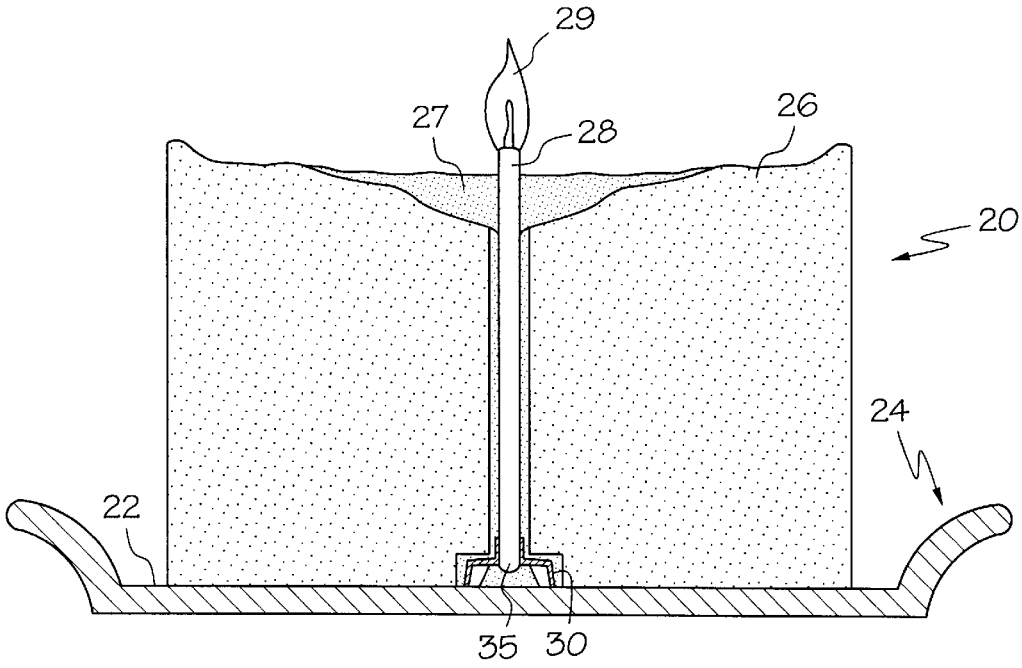
FIG. 2 shows a cross-sectional view of an exemplary use of the candle shown in FIG. 1 as it might appear during burning.
Figure 3:
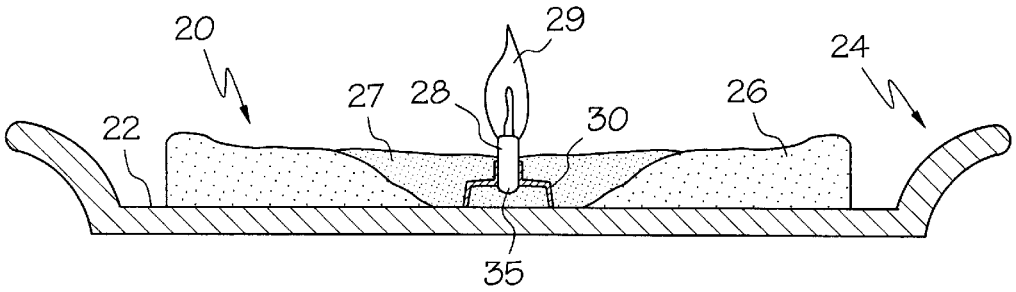
FIG. 3 shows another cross-sectional view of an exemplary use of the candle shown in FIG. 1 as it might appear after substantial burning.

Preferably, the wick 28 is fibrous and has been coated with a narrow cylinder of candle wax 33 (not shown), such as paraffin. When the wick 28 is lit, fuel 26 is drawn through the wick to feed the flame 29. As shown in FIGS. 2 and 3, in conventional wax candles and the like, the flame 29 on the wick 28 must first melt the fuel 26 into a molten fuel pool 27 that comes into contact with the wick in order to transform the fuel into a useable liquid form.

Heat from the flame 29 is transferred to the wick clip 30. The wick clip 30, in turn, transfers heat to the supporting surface 22 of the display 24. In a supporting surface 22 comprised of materials such as glass or the like, the supporting surface may become damaged, crack, or fracture if a portion of it experiences more heat than an adjacent portion. Moreover, the candle 20 will continue burning as long as a portion of the wick 28 contacts the liquefied fuel 26.

Figure 4:
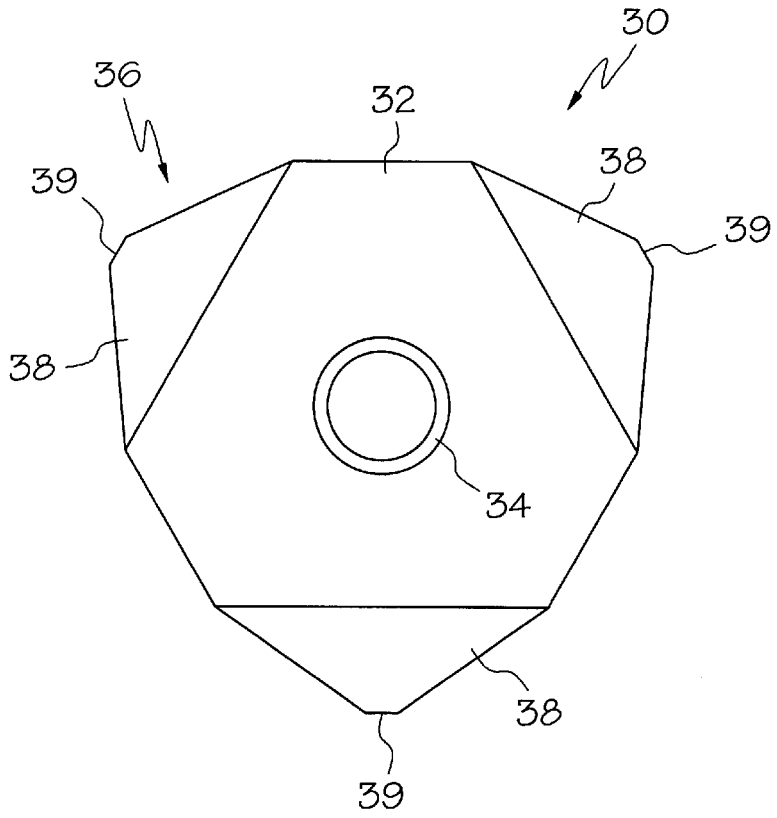
FIG. 4 shows a top view of the candle wick clip shown in FIG. 1.
Figure 5:
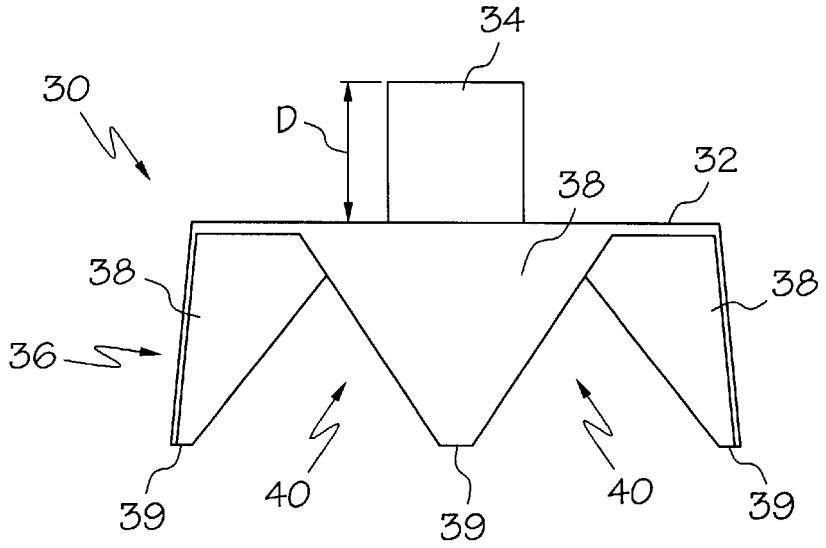
FIG. 5 shows a side view of the candle wick clip shown in FIG. 1.

FIGS. 4 and 5 illustrate several views of one preferred embodiment of a wick clip 30 according to the present invention. The wick clip 30 includes a base 32, wick receiving member 34, and skirt 36. The base 32 is preferably relatively flat and can comprise a variety of overall conformations, such as generally round or polygonal. While a generally triangular conformation (as seen in these drawings) is preferred from a performance perspective, it may be easier to incorporate the round conformation into existing manufacturing processes.

The wick receiving member 34 is disposed adjacent to the top surface of the base 32, preferably in a substantially vertical orientation and substantially centrally disposed. Preferably, the wick receiving member 34 extends upwardly and vertically for a distance D of at least about 0.125 inches from the base 32, allowing sufficient room to attach a wick 28 without making the wick receiving member unnecessarily tall. Making the wick receiving member 34 taller than it needs to be to properly attach the wick 28, may lead to problems with relighting a wax or other solid fuel candle when the wick is burnt down to the top of the wick receiving member such that there is no longer an appreciable amount of the wick left exposed. In this scenario, if the wick 28 is extinguished at this point while the level of the fuel 26 is below the top of the wick receiving member 34, but is above the bottom of the wick, and the fuel is allowed to cool and solidify, a user will have problems relighting the candle 20 as the remaining burnable material of the wick will burn out before enough fuel will melt to create capillarity in the wick to feed the flame 29. Therefore, it is desirable to minimize the distance D to avoid user complaints regarding an inability to relight the candles that still have an appreciable amount of fuel 26.

As with the base 32, the wick receiving member 34 can also have a variety of shapes. Preferably, the wick receiving member 34 comprises a generally tubular conformation, and can be integrally formed with the base 32 or affixed thereto such as by welding, solder, brazing, adhesive, or spin welding. Moreover, although it is preferred that the wick receiving member 34 should only allow the wick 28 to draw the fuel 26 from points on the wick above and below the wick receiving member, the wick receiving member can also be provided with one or more apertures that allow, or formed from a material that allows, the fuel to access the wick from points along the length of the wick receiving member. Alternatively, wick receiving member 34 might be formed in an at least partially open or skeletal manner to facilitate access to the wick 28 by molten fuel 26.

The skirt 36 is generally open and extends downwardly from the base 32. A generally open skirt 36 is one that comprises at least one supporting element with at least one substantial open space disposed on or between such elements. Preferably, the skirt 36 includes a plurality of downwardly extending legs 38 and a plurality of flow passages 40, although it may have other configurations. For example, the skirt 36 may also include a member depending from the base that is provided with at least one aperture.

The skirt 36 is also adapted to maintain the base 32 in a predetermined spaced relationship relative to a supporting surface 22 in use, as shown in FIGS. 1–3. For example, the preferred embodiment of the skirt 36 elevates the base 32 generally parallel to and above the supporting surface 22 when the distal ends 39 of legs 38 rest on the supporting surface. Spacing the base 32 of the wick clip 28 from the supporting surface 22 in this manner reduces the amount of heat transferred from the wick clip 30 to the supporting surface. This spacial relationship may also affect the positioning of the bottom end 35 of the wick 28 relative to the supporting surface 22, the impact of which is discussed below. In a preferred form, the skirt 36 elevates the base 32 so that it is generally parallel to and at least about 0.125 inches above the supporting surface 22 (shown in the figures as height B).

Figure 6:
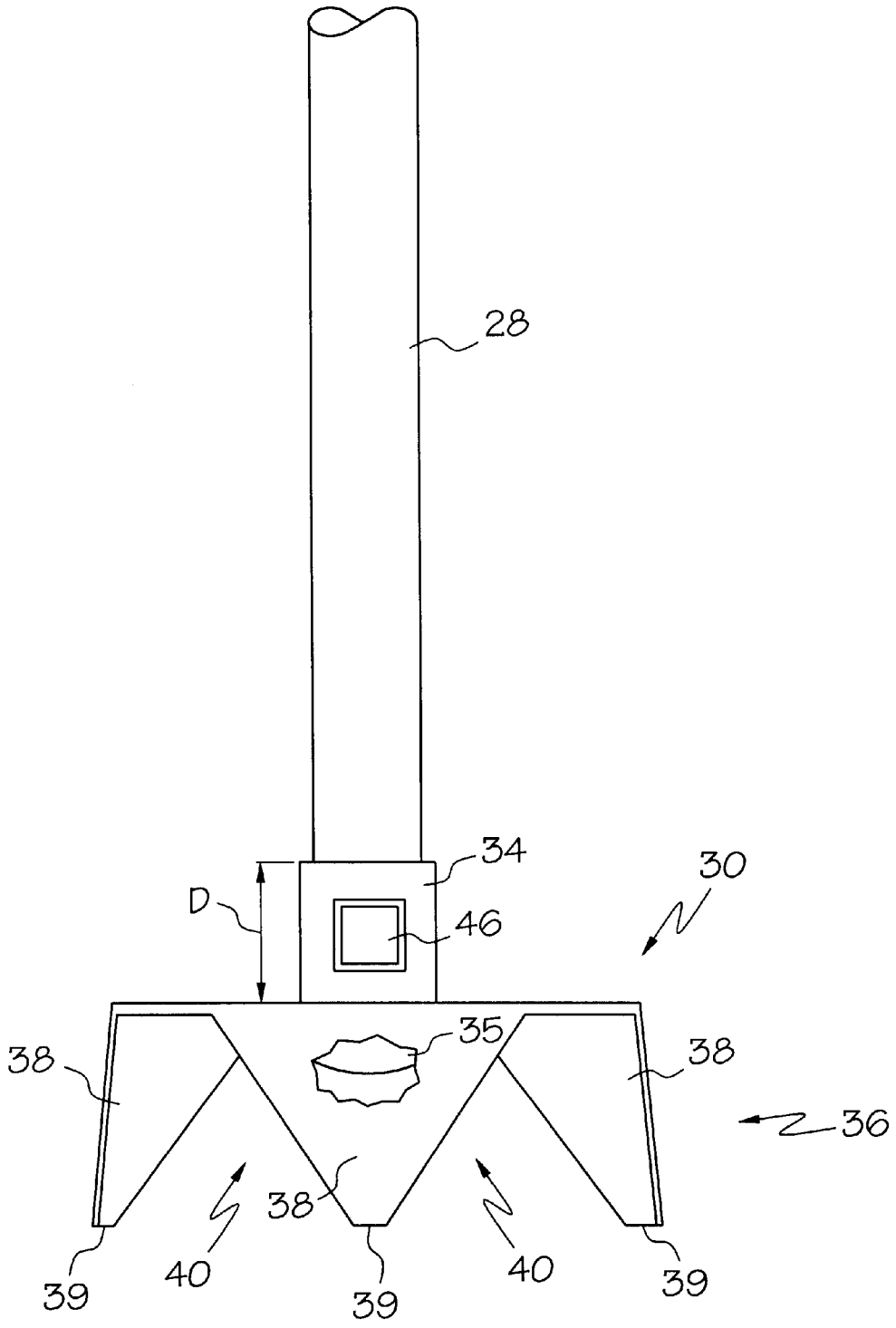
FIG. 6 shows a partially broken out side view of the candle wick assembly, including the wick and wick clip, shown in FIG. 1.

As shown in FIG. 6, a wick 28 is securely and non-movably attached to the wick clip 30 with the bottom end 35 of the wick penetrating the base 32. Moreover, and as shown in FIGS. 1–3, the wick 28 is preferably attached so that its bottom end 35 would be located at a point above a supporting surface 22 in use. Preferably, the wick receiving member 34 is crimped about or into the wick 28, for example at crimp location 46, to securely and non-movably attach the wick to the wick clip 30.

Figure 7:
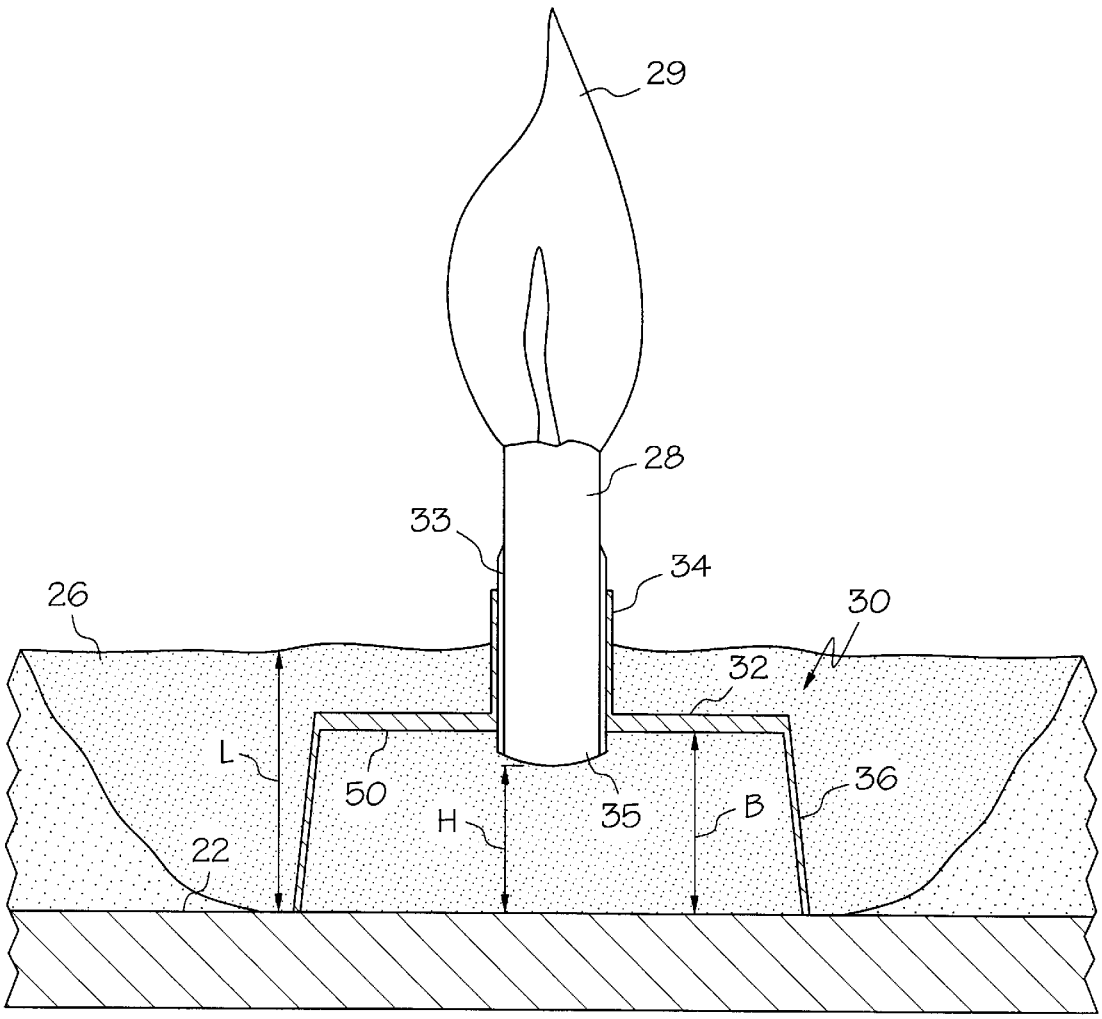
FIG. 7 shows a partial, enlarged cross-sectional view of another exemplary use of the candle wick clip assembly as shown in FIG. 1.
Figure 7A:
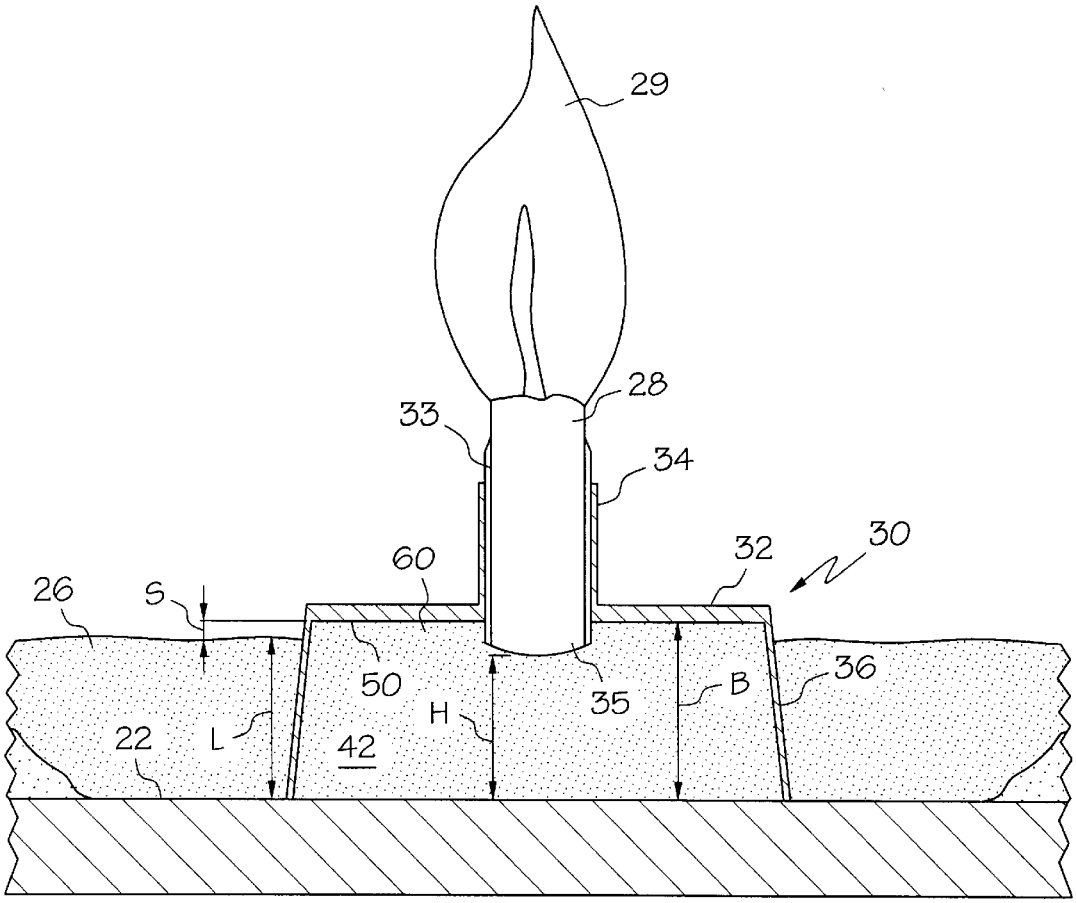
FIG. 7A shows another partial, enlarged cross-sectional view of an exemplary use of the candle wick clip assembly as shown in FIG. 1.
Figure 8:
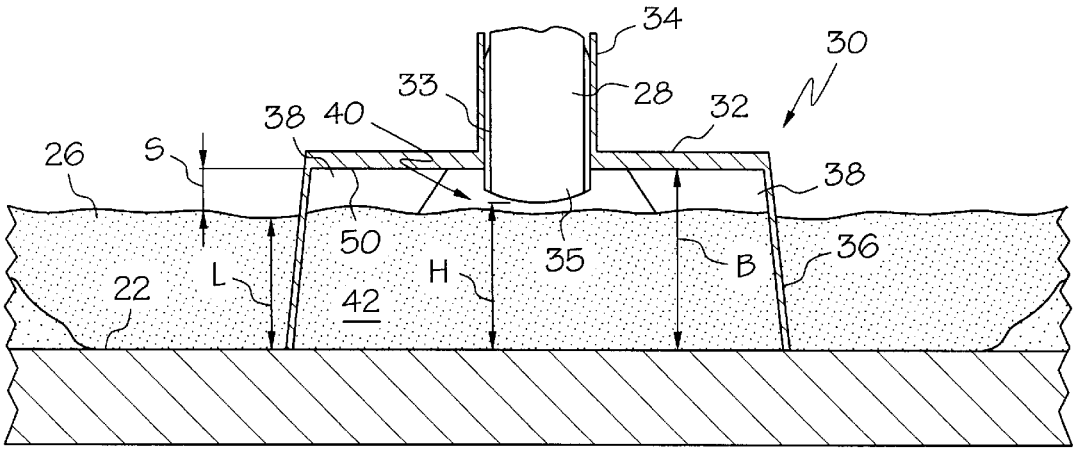
FIG. 8 shows yet another partial, enlarged cross-sectional view of an exemplary use of the candle wick clip assembly shown in FIG. 1.

FIGS. 7, 7A, and 8 illustrate the operation of a wick 28 and wick clip 30 during candle burning according to one embodiment of the present invention. According to this embodiment, the skirt 36 reduces the amount of heat transferred from the flame 29 and wick clip 30 to the supporting surface 22 by limiting the amount of the surface area of the wick clip that comes into contact with the supporting surface. Preferably, the skirt 36 is fashioned to also minimize the surface area of the wick clip 30 that is in close proximity to the supporting surface 22. In addition, the skirt 36 can also increase the distance between the flame 29 and the supporting surface 22. Therefore, the skirt 36 according to this embodiment reduces the transfer of heat and the likelihood that the supporting surface 22 will degrade, break, or fracture from overheating.

As the wick 28 burns fuel 26, the level of the molten pool of fuel lowers. Even after the level of the pool of fuel 26 lowers below the lowest point on the wick receiving member 34 above the base 32 that allows fuel to penetrate the wick 28, the skirt 36 allows the fuel to be continually drawn into the bottom end 35 of the wick from the pool of fuel 26 below the base. Once the pool of fuel 26 lowers to a level (L) below the bottom end 35 of the wick 28, the wick is preferably cut off from the fuel and the flame 29 extinguishes, leaving a prespecified residuary pool of fuel 42 on top of the supporting surface 22 (as seen in FIG. 8). Therefore, according to the present invention, the height of a residuary pool of fuel 42 can be prespecified by attaching the wick 28 to the wick clip 30 so the bottom of the wick is at the predetermined height (H) in relation to the supporting surface 22.

The residuary pool of fuel 42 also helps prevent flaring by entrapping and blocking extraneous material (such as carbon and other debris from the burning wick and/or implements used to light the candle) away from the flame 29. By ensuring that a pool of fuel 26 always exists on top of the supporting surface 22, the heat will also be more widely dispersed across a larger portion of the supporting surface, thereby reducing the likelihood of fracturing or otherwise degrading the supporting surface. Moreover, it may be more acceptable to potential consumers of the present invention if the residuary pool of fuel 42 is optimized so that an excessive amount of unburnt fuel is not left after the candle self-extinguishes. Preferably, a residuary pool 42 of approximately 0.040–0.125 inches in height is left on top of the supporting surface 22. While other heights of residuary pools 42 may be utilized with the present invention, a height within this range is optimal.

As shown in FIG. 7A, as the level L of the fuel 26 drops below the height B of the base 32, attractive forces between the underside 50 of the base and the fuel retain a capillary column 60 of the fuel. If these attractive forces are not broken, a meniscus of the fuel 26 may form underneath the base 32 that might allow the wick 28 to continue drawing fuel after the fuel level L drops below the bottom end 35 of the wick. The skirt 36 according to the present invention allows for optimal control of the residuary pool of fuel 42 by reducing these attractive forces.

According to one embodiment of the present invention, for example, the at least one substantial open space of generally open skirt 36 reduces the lateral support provided for the capillary column 60 of fuel 26, thereby allowing gravitational forces to overcome the interfacial tension between the surface of the base 32 and the fuel after a considerably smaller separation S between the level L of the fuel and the base than if the capillary column was otherwise supported. Accordingly, the interfacial tension will be overcome while the fuel 26 is at higher levels L than if supported. Enlarging the open spaces on the skirt 36, particularly those provided on the skirt between the height B of the base 32 and the height H of the bottom end 35 of the wick 28, so that more of the capillary column 60 of fuel 26 is unsupported, significantly enhances the breaking of this tension by allowing the meniscus to break after even smaller separations S. Meanwhile, the size and shape of the underside 50 of the base 32 appears to have a minimal effect in comparison to the size and shape of the vertical surfaces of the skirt 36.

In an embodiment of the present invention where the skirt 36 comprises a plurality of downwardly extending legs 38 and flow passages 40, as shown in FIGS. 4–8, the combined "surface area" of the flow passages is preferably at least as large as the combined inner surface areas of the legs. In a preferred embodiment, the "surface area" of each of the flow passages is preferably at least as large as the inner surface area of the adjacent corresponding leg. In a further preferred embodiment the surface areas of corresponding legs 38 and flow passages 40 are approximately equal. Moreover, the wick 28 is preferably attached to the wick clip 30 so that the bottom end 35 of the wick will be maintained at least about 0.125 inches from a supporting surface 22.

The wick clip 30, according to the present invention, may also provide additional benefits. As mentioned above, the skirt 36 may elevate the wick 28 so that the flame 29 will not come into contact with extraneous material as the pool of fuel 26 lowers, reducing the likelihood of flaring. Moreover, the skirt 36 may also function to laterally separate and deflect extraneous material from the flame 29. Furthermore, in a preferred form, the diameter of the base 32 is increased to, for example, laterally separate the flame 29 from any edges of the supporting surface 22 or display 24 if the wick clip 30 should "walk" on the supporting surface (as can be understood by one of ordinary skill in the art, on some supporting surfaces, the clip can "walk" along the supporting surface when the fuel 26 becomes substantially all liquid).

Referring back to FIGS. 4 and 5, although the base 32, wick receiving member 34, and skirt 36 can be formed from different materials, they each are preferably formed from a non-flammable material. While the wick clip 30 is preferably comprised of steel or a similar metallic material, it could also be comprised from a variety of materials such as, for example, a ceramic or non-combustible plastic material. The choice of materials may change the interfacial tension between the base 32 and the fuel 26, therefore, a material which reduces the attractive forces between the base and the fuel is preferred. In addition, the base 32, wick receiving member 34, and skirt 36 are preferably formed from a thin, malleable material. Preferably, the base 32, wick receiving member 34, and skirt 36 are also integrally connected.

Figure 9:
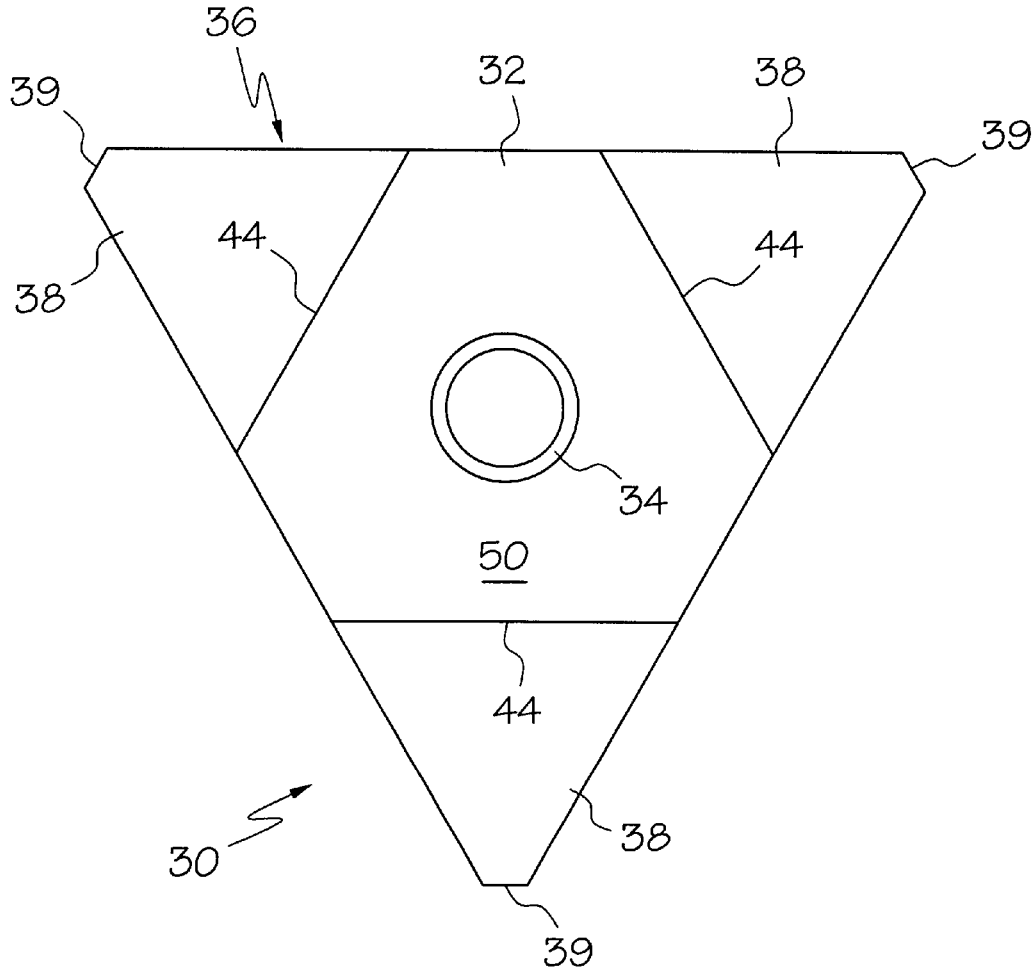
FIG. 9 shows a bottom view of a base and wick receiving member used to form the candle wick clip shown in FIG. 1.

As shown in FIG. 9, the base 32 of a wick clip 30 is preferably formed from a relatively flat piece of material, which can have a variety of initial conformations, such as, for example, generally round or polygonal. Although a generally round conformation may be easier to manufacture, a generally polygonal conformation, such as, for example, triangular, square, rectangular, or diamond, is preferred from a performance standpoint. Of these, the triangular conformation is most preferred and can be used to form a wick clip 30 with three spaced legs 38. A wick receiving member 34 is provided on the base 32. The skirt 36 is then preferably formed by bending the base 32 downwardly away from the wick receiving member 34 along a plurality of equidistant bend lines 44 to form legs 38 and flow passages 40 as described generally above.

Figure 10:
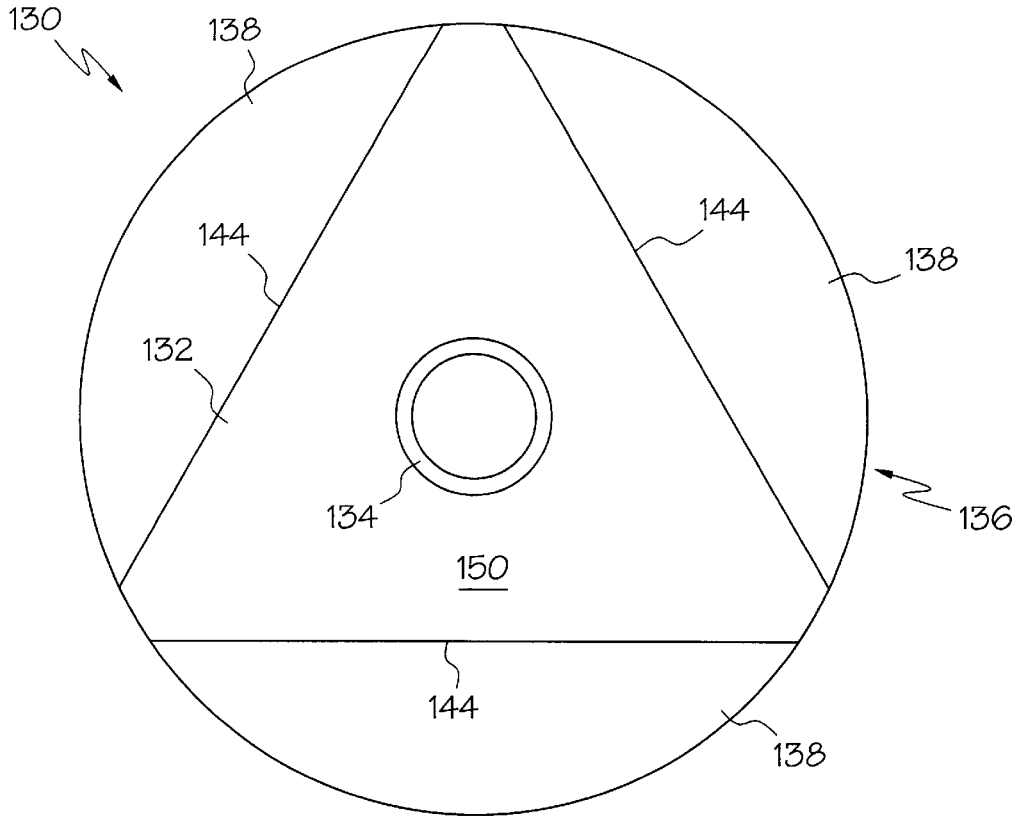
FIG. 10 shows a bottom view of a base and wick receiving member used to form a candle wick clip according to another embodiment of this invention.
Figure 11:
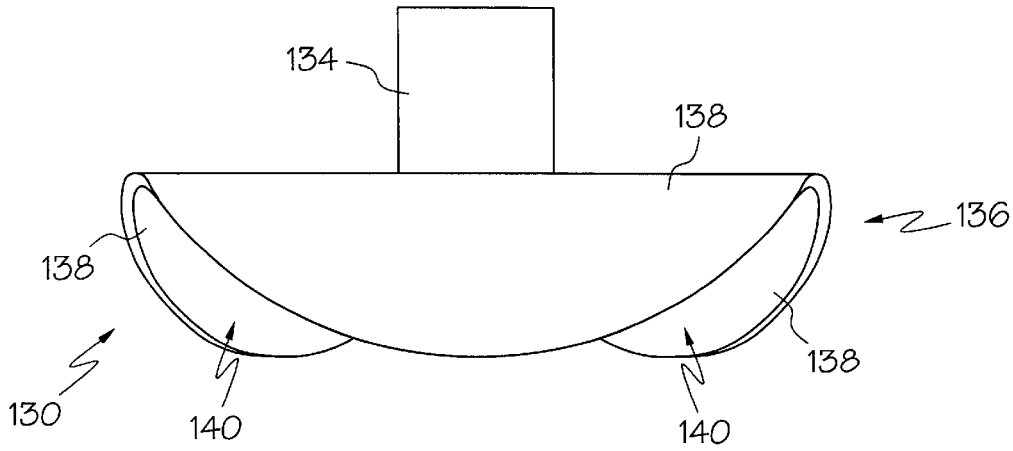
FIG. 11 shows a side view of the candle wick clip formed from the base and wick receiving member shown in FIG. 10.

Another embodiment of a wick clip made according to the present invention is shown in FIGS. 10 and 11. The wick clip 130 illustrated in this embodiment has a base 132, wick receiving member 134, and skirt 136. In this embodiment, the skirt 136 is formed by bending the generally round base 132 downwardly substantially along the equidistant bend lines 144 to form legs 138 and flow passages 140.

Figure 12:
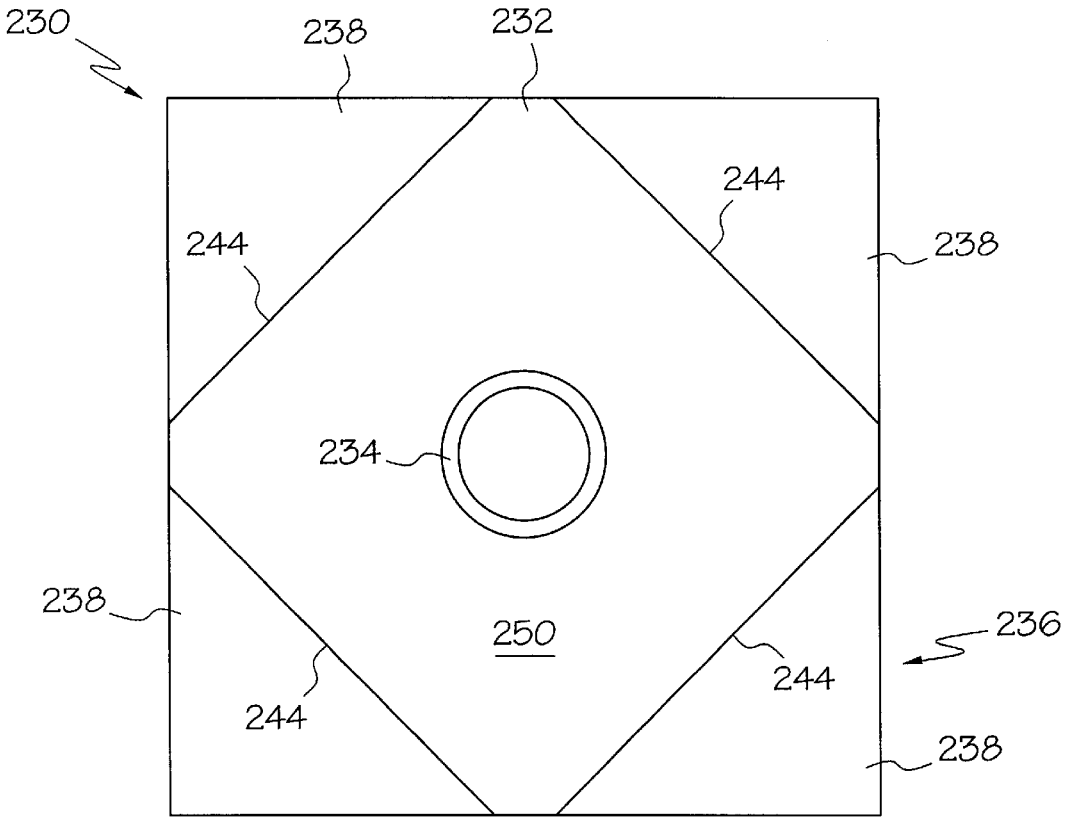
FIG. 12 shows a bottom view of a base and wick receiving member used to form a candle wick clip according to still another embodiment of this invention.
Figure 13:
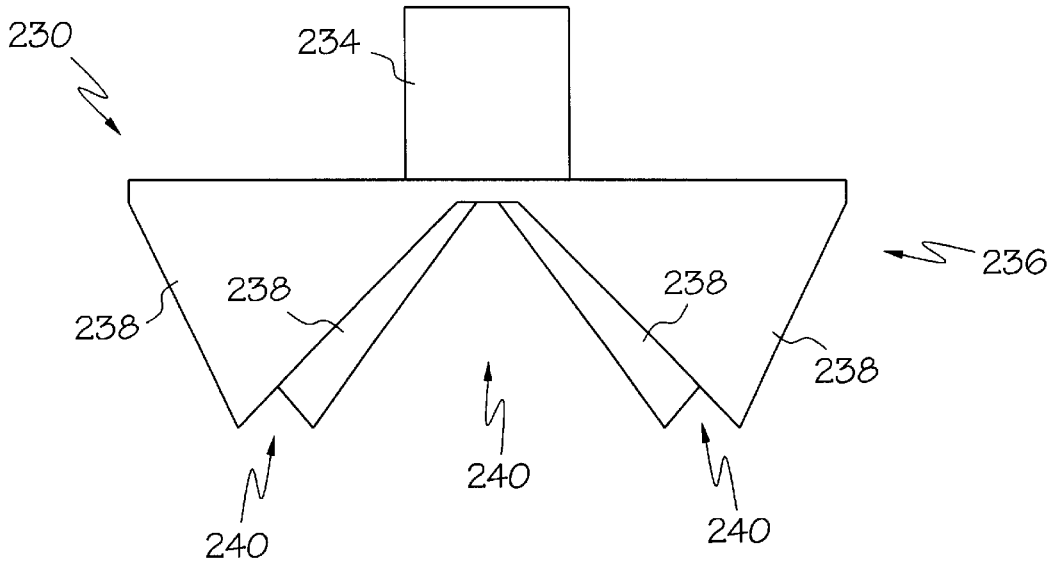
FIG. 13 shows a side view of the candle wick clip formed from the base and wick receiving member shown in FIG. 12.

Still another embodiment of a wick clip made according to the present invention is shown in FIGS. 12 and 13. The wick clip 230 illustrated in this embodiment has a base 232, wick receiving member 234, and skirt 236. In this form, the skirt 236 is formed by bending the generally square base 232 downwardly substantially along the equidistant bend lines 244 to form legs 238 and flow passages 240.

Figure 14:
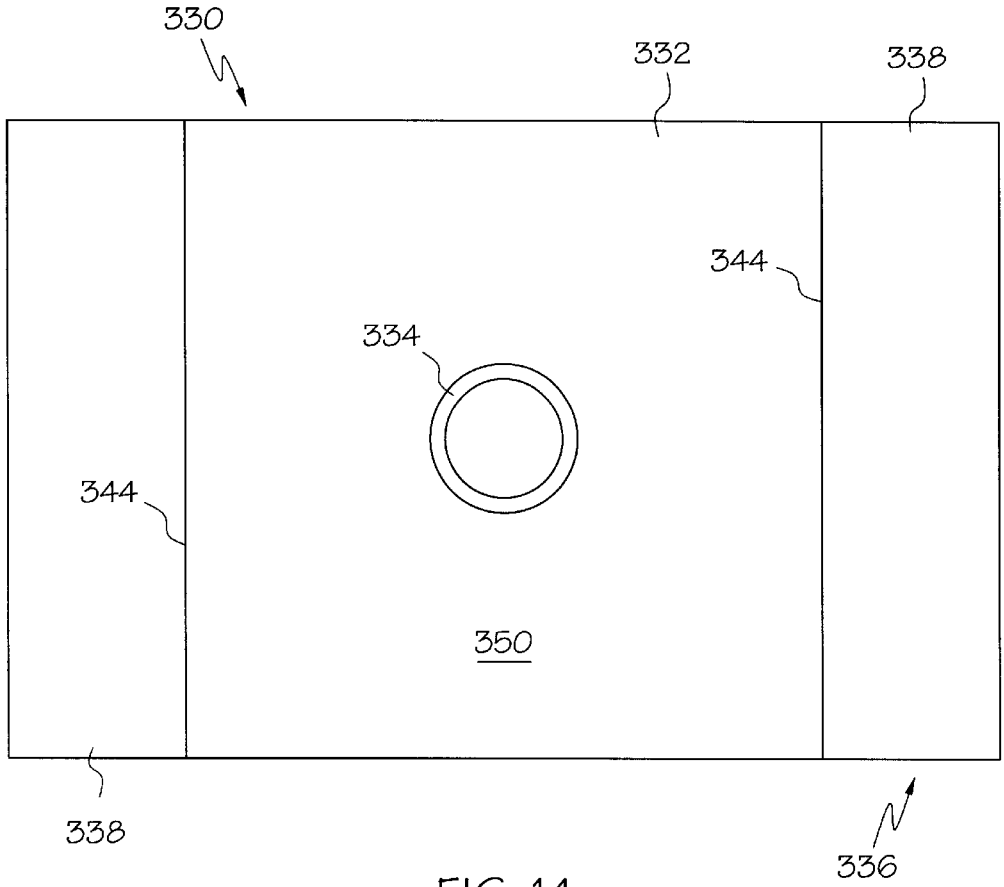
FIG. 14 shows a bottom view of a base and wick receiving member used to form a candle wick clip according to yet another embodiment of this invention.
Figure 15:
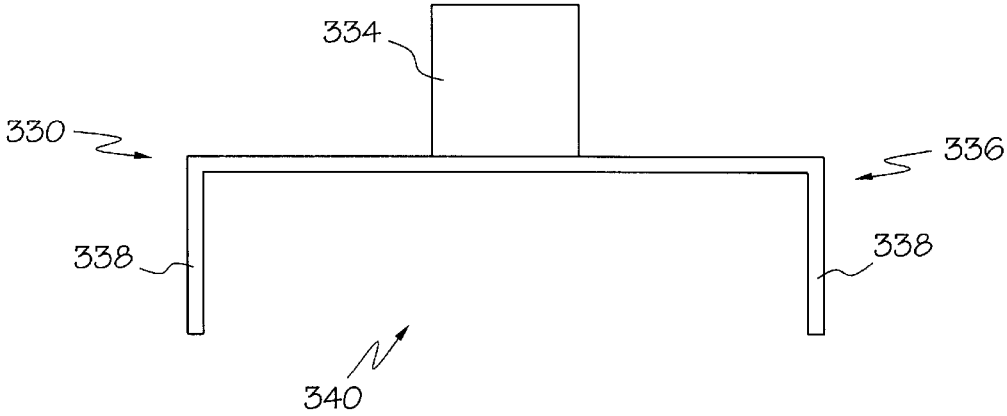
FIG. 15 shows a side view of the candle wick clip formed from the base and wick receiving member shown in FIG. 14.

Yet another embodiment of a wick clip made according to the present invention is shown in FIGS. 14 and 15. The wick clip 330 shown in this embodiment has a base 332, wick receiving member 334, and skirt 336. In this embodiment, the skirt 336 is formed by bending the generally rectangular base 332 downwardly substantially along the equidistant bend lines 344 to form legs 338 and flow passages 340.

A candle 20, as depicted in FIG. 1, is preferably formed by first attaching a wick 28 to the wick receiving member 34. While the wick 28 can be attached to the wick receiving member 34 in a variety of fashions such as, for example, through the use of adhesives, indentations, interference fittings, tines, or the like, it is preferred to crimp the wick receiving member into or about the wick (as shown in FIG. 6). While it is preferred to bend the base 32 to form the legs 38 and flow passages 40 after the wick 28 is attached to the wick receiving member 32, it could be bent before or during attachment as well.

Next, the top of wick 28 is inserted into the wick passage 31 from the bottom of the candle 20. Then, the wick 28 is drawn through or pushed into the wick passage 31 so that the distal end of the skirt 36 of the attached wick clip 30 is brought into a generally coplanar relationship with the bottom end of the candle 20, as illustrated in FIG. 1. The wick clip 30 can be inserted into the bottom of the candle 20 in a variety of ways such as, for example, by placing it within the candle in an interference fit within the candle, or by placing the clip within a countersink within the candle and holding it there within by bending the top of the wick 28 at the top of the candle (holding the clip in place until the candle is placed on a supporting surface 22) or by securing an object, such as an adhesive label for example, across the bottom of the candle.

The wick clip assembly according to the present invention can be manufactured quickly and inexpensively, and requires minimal assembly. The foregoing detailed description of the invention has been presented for purposes of illustration and description. It is not intended to be exhaustive nor limit the invention to the precise form disclosed. Many alternatives, modifications and variations have been discussed above, and others will be apparent to those skilled in the art in light of the above teaching. Accordingly, this invention is intended to embrace all such alternatives, modifications and variations that fall within the spirit and broad scope of the appended claims and their equivalents.

We claim:

1. A candle wick clip assembly for candles to be used with a display having a supporting surface, said wick clip comprising:

a) a base having a top and bottom surface;

b) a wick receiving member disposed adjacent the top surface of the base;

c) a generally open skirt extending downwardly from the base and adapted to maintain the base in a predetermined spaced relationship relative to a supporting surface in use, said generally open skirt comprising at least one supporting element and at least one substantial open space; and d) a wick having a top and bottom end, said bottom end of the wick penetrating the base, and being securely and non-movably attached to said assembly by said wick receiving member such that its bottom end is located at a point above the supporting surface in use sufficient to leave an unused residuary pool of molten candle fuel on top of the supporting surface as the wick is cut off from the fuel in use, the at least one substantial open space being in fluid communication with the bottom end of the wick.

2. A candle wick clip assembly as recited in claim 1, wherein said wick receiving member comprises a generally tubular member.

3. A candle wick clip assembly as recited in claim 1, wherein said wick receiving member is crimped to securely attach the wick to said clip assembly.

4. A candle wick clip assembly as recited in claim 1, wherein said bottom end of the wick is held at least about 0.125 inches from the supporting surface.

5. A candle wick clip assembly as recited in claim 1, wherein said wick receiving member is centrally disposed on the base in a substantially vertical orientation.

6. A candle wick clip assembly as recited in claim 5, wherein said wick receiving member extends upwardly and vertically at least about 0.125 inches from the base.

7. A candle wick clip assembly as recited in claim 1, wherein said base, wick receiving member, and skirt are integrally connected.

8. A candle wick clip assembly as recited in claim 1, wherein the substantial open space is located on the supporting element.

9. A candle wick clip assembly as recited in claim 1, further comprising at least two supporting elements, the substantial open space being located between the supporting elements.

10. A candle wick clip assembly as recited in claim 1, wherein the at least one supporting element comprises a plurality of downwardly extending legs and the at least one substantial open space comprises a plurality of flow passages.

11. A candle wick clip assembly as recited in claim 1, wherein the skirt allows the fuel to be continually drawn into the wick until only the residuary pool remains.

12. A candle wick clip assembly as recited in claim 1, wherein the skirt allows the fuel to be drawn into the bottom end of the wick until only the residuary pool remains.

13. A candle wick clip assembly for candles to be used with a display having a supporting surface, said wick clip comprising:

a) a base having a top and bottom surface;

b) a wick receiving member disposed adjacent the top surface of the base;

c) a generally open skirt extending downwardly from the base and adapted to maintain the base in a predetermined spaced relationship relative to a supporting surface in use, wherein said skirt comprises a plurality of downwardly extending legs and a plurality of flow passages; and d) a wick having a top and bottom end, said bottom end of the wick penetrating the base, and being securely and non-movably attached to said assembly by said wick receiving member such that its bottom end is located at a point above the supporting surface in use sufficient to leave an unused residuary pool of molten candle fuel on top of the supporting surface as the wick is cut off from the fuel in use.

14. A candle wick clip assembly as recited in claim 13, wherein each of said flow passages comprises a passage surface area, and each leg comprises a leg surface area, each of said passage surface areas being approximately equal to each corresponding leg surface area.

15. A candle wick clip assembly as recited in claim 13, wherein each of said flow passages comprises a passage surface area, and each leg comprises a leg surface area, each of said passage surface areas being larger than a corresponding leg surface area.

16. A candle wick clip assembly as recited in claim 13, wherein said base and said skirt are formed from a material initially having a generally polygonal conformation.

17. A candle wick clip assembly as recited in claim 16, wherein said generally polygonal conformation comprises a generally triangular conformation.

18. A candle wick clip assembly as recited in claim 13, wherein said base and said skirt are formed from a material initially having a generally round conformation.

19. A method for making a wick clip for a candle to be used with a candle display having a supporting surface, comprising the steps of:

a) providing a base;

b) providing a wick receiving member on the base;

c) bending said base along a plurality of equidistant bend lines whereby a plurality of downwardly extending legs and flow passages are formed such that the base and wick receiving member will be spaced from a supporting surface in use by said legs; and d) non-movably attaching a wick to said wick receiving member such that a bottom end of the wick is located at a point above the supporting surface in use sufficient to leave an unused residuary pool of molten candle fuel on top of the supporting surface as the wick is cut off from the fuel in use.

20. A method for making a wick clip according to claim 19, wherein said wick is attached to the wick receiving member before the base is bent.

21. A method for making a wick clip according to claim 19, wherein said wick is attached to the wick receiving member while the base is being bent.

22. A method for making a wick clip according to claim 19, wherein said wick is attached to the wick receiving member after the base is bent.

23. The method of claim 19, wherein said wick is attached to said base such that its bottom end extends downwardly below said base only a portion of the length of said legs, whereby said bottom end will be spaced upwardly from the supporting surface in use.

24. A method for making a candle with an improved supported wick comprising the steps of:

a) providing a candle having upper and lower ends;

b) providing a wick passage running between the upper and lower ends of the candle;

c) providing a wick clip base;

d) providing a wick receiving member on the base;

e) providing a wick, said wick having top and bottom ends and being longer than the wick passage;

f) non-movably attaching said wick to the wick receiving member adjacent its bottom end;

g) bending said base along a plurality of equidistant bend lines to form a plurality of flow passages and downwardly extending legs having distal ends;

h) inserting said top end of the wick into the wick passage; and

I) passing said top end of the wick through the wick passage until the distal ends of the downwardly extending legs are generally coplanar with the lower end of the candle.

25. The method of claim 24, wherein the bottom end of said wick extends downwardly from said base for a distance which is less than the downwardly extended length of said distal ends of the legs such that the bottom end of the wick is located at a point above the supporting surface in use sufficient to leave an unused residuary pool of molten candle fuel on top of the supporting surface as the wick is cut off from the fuel in use.

* * * * *